US006015649A

United States Patent [19]

Mori

[11] Patent Number: 6,015,649

[45] Date of Patent: Jan. 18, 2000

[54] METHOD OF MANUFACTURING SUPPORT FOR PLANOGRAPHIC PRINTING PLATE

[75] Inventor: Takahiro Mori, Hino, Japan

[73] Assignee: Konica Corporation, Tokyo, Japan

[21] Appl. No.: 08/872,773

[22] Filed: Jun. 10, 1997

[30] Foreign Application Priority Data

Jun. 12, 1996 [JP] Japan ..... 8-151036

[51] Int. Cl.[7] ..... G03C 1/52; C25F 1/02

[52] U.S. Cl. ..... 430/193; 430/300; 205/214; 205/646; 205/704; 216/102; 216/103

[58] Field of Search ..... 430/193, 300; 205/646, 704, 214; 216/102, 103

[56] References Cited

U.S. PATENT DOCUMENTS

| | | |
|---|---|---|
| 1,412,768 | 4/1922 | Barber . |
| 2,760,863 | 8/1956 | Plambeck . |
| 2,791,504 | 5/1957 | Plambeck . |
| 3,030,208 | 4/1962 | Schellenberg et al. . |
| 3,300,309 | 1/1967 | Chu . |
| 3,435,237 | 3/1969 | Collins . |
| 3,511,661 | 5/1970 | Rauner et al. . |
| 3,544,842 | 12/1970 | Yampolsky . |
| 3,622,208 | 11/1971 | Krugler et al. . |
| 3,660,097 | 5/1972 | Mainthia . |
| 3,751,257 | 8/1973 | Dahlman . |
| 4,123,276 | 10/1978 | Kita et al. . |
| 5,041,198 | 8/1991 | Hausmann . |
| 5,304,298 | 4/1994 | Brenk ..... 205/106 |

FOREIGN PATENT DOCUMENTS

| | | |
|---|---|---|
| 0 129 338 | 12/1984 | European Pat. Off. . |
| 0 422 682 A2 | 4/1991 | European Pat. Off. . |
| 0 701 908 A2 | 3/1996 | European Pat. Off. . |
| 0 757 122 A1 | 2/1997 | European Pat. Off. . |

OTHER PUBLICATIONS

Derwent Abstract of JP 880071629 Sep. 1989.

*Primary Examiner*—Mark Chapman
*Attorney, Agent, or Firm*—Finnegan, Henderson, Farabow, Garrett & Dunner, L.L.P.

[57] ABSTRACT

A method of manufacturing a support of a presensitized planographic printing plate is disclosed, the method comprising electrolytically surface-roughening an aluminum plate or an aluminum alloy plate in an acidic electrolyte solution, the surface-roughening step comprising plural pairs of first high surface-roughening rate steps and second low or zero surface-roughening rate steps, the first step and the second step being carried out alternately, wherein an average quantity of electricity of 100 C/dm$^2$ or less is applied at one of the first steps.

11 Claims, 2 Drawing Sheets

METHOD OF MANUFACTURING SUPPORT FOR PLANOGRAPHIC PRINTING PLATE

FIELD OF THE INVENTION

The present invention relates to a method of manufacturing a support for a planographic printing plate, a support obtained by the method and a presensitized planographic printing plate employing the support, and particularly, to a method of manufacturing a support for a planographic printing plate, a support for a planographic printing plate obtained by the method and a presensitized planographic printing plate employing the support, wherein dot gain at high fineness (600 lines/inch) and light-sensitive layer damage caused by a ball-point pen have been minimized.

BACKGROUND OF THE INVENTION

Heretofore, there has been employed an electrolytic surface-roughening method as one of surface-roughening methods for a support of a planographic printing plate. However, when trying to obtain the surface roughness necessary for a support of a planographic printing plate only through electrolytic surface-roughening, the roughened surface has not been uniform sufficiently. In the case of electrolysis of the support in an electrolytic solution mainly containing hydrochloric acid, in particular, too large pits exceeding 10 $\mu$m in terms of an opening size have tended to be generated, flat portions have remained unroughened without generation of relatively large pit having an opening size of 3–10 $\mu$m, and only an unevenly roughened surface has been obtained.

In the case of electrolysis of the support in an electrolytic solution mainly containing nitric acid, on the other hand, too large pits exceeding 10 $\mu$m in terms of an opening size has hardly been generated, the distribution of the opening size has focused on a range of 1–3 $\mu$m, and generation of pits with an opening size of 1 $\mu$m or less has been only a little. Therefore, the resulting support tends to soil a blanket of a printing machine, though the roughened surface has been uniform.

To solve the problems mentioned above, there is employed a method wherein relatively large pits are formed through mechanical surface-roughening, while small pits with an opening size of about 1 $\mu$m are formed through electrolytic surface-roughening. However, pits or swells formed through the mechanical surface-roughening corresponds to pits having an opening size of about 10 $\mu$m, and it has been impossible to form a pit having an opening size ranging from about 3 $\mu$m to 6 $\mu$m.

Further, Japanese Patent Examined Publication No. 98429/1995 discloses that generation of too large pits having an opening size of 10 $\mu$m or more can be eliminated by providing at least two standstills during electrolytic processing, in the case of the electrolytic surface-roughening. However, in the method disclosed by Japanese Patent Examined Publication No. 98429/1995, it is still impossible to obtain sufficient uniformity, and properties to minimize both dot gain at high fineness and ball-point pen damage have not been satisfactory.

The present inventors have found, after perceiving split processing for the electrolytic surface-roughening and conducting various studies, that what is closely related to uniformity of grain is not the number of the standstills but an average quantity of electricity to be applied during one of electrolytic processing steps, and that no effect of uniformalization is obtained when a period of time for the standstill of electrolytic processing is 0.5 sec or less, and the effect of uniformalization can be obtained even when an electric current for the electrolysis is completely cut for the period of standstill. They have further found that the uniformalization can provide a remarkable effect for an improvement in properties to minimize both dot gain at high fineness and a ball-point pen damage. Thus, they have achieved the present invention.

SUMMARY OF THE INVENTION

An object of the invention is to provide a method of manufacturing a support of a presensitized planographic printing plate, the support having uniform pits, minimizing too large pits, and resulting in improved dot gain at high fineness and minimized ball point pen damage of the light sensitive layer, a support for a planographic printing plate obtained by the method, and a presensitized planographic printing plate employing the support.

BRIEF EXPLANATION OF THE INVENTION

DETAILED DESCRIPTION OF THE INVENTION

Figure 1:
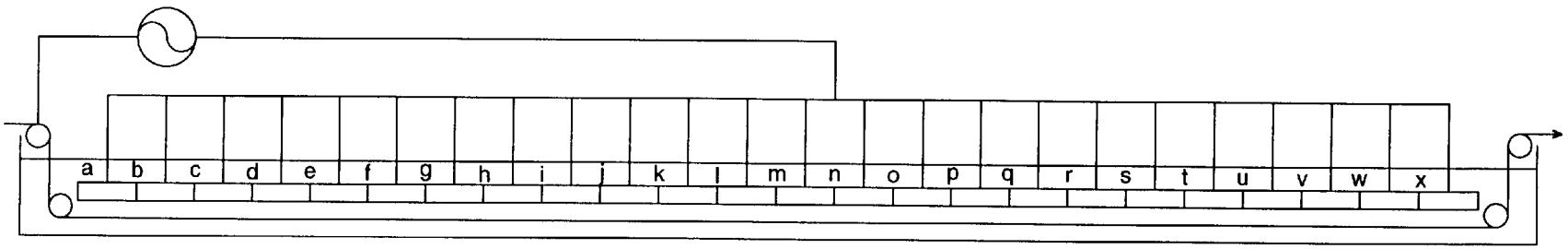
FIG. 1 is a sectional view of an electrolytic apparatus (showing conditions of Comparative example 1-1).

The above objects of the invention can be attained by the followings:

1. a method of manufacturing a support for a presensitized planographic printing plate, the method comprising the step of:
   electrolytically surface-roughening continuously an aluminum web or an aluminum alloy web transported in an acidic electrolytic solution, the step comprising plural pairs of first high surface-roughening rate steps and second low or w zero surface-roughening rate steps, the first step and the second step being carried out alternately, wherein an average quantity of electricity of 100 C/dm$^2$ or less is applied at one of the first steps,
2. the method of item 1 above, wherein the second steps are carried out in 0.6 to 5 seconds,
3. a method of manufacturing a support for a presensitized planographic printing plate, the method comprising the step of:
   electrolytically surface-roughening an aluminum plate or an aluminum alloy plate in an acidic electrolyte solution, the step being carried out by varying current density to be supplied to comprise plural pairs of first high surface-roughening rate steps and second low or zero surface-roughening rate steps, the first step and the second step being carried out alternately, wherein an average quantity of electricity of 100 C/dm$^2$ or less is applied at one of the first steps,
4. The method of item 3 above, wherein the second steps are carried out in 0.6 to 5 seconds,
5. a method of manufacturing a support for a presensitized planographic printing plate, the support having large pits of an average opening size of 3 to 6 $\mu$m and small pits on the surface, the method comprising the step of:
   (a) electrolytically surface-roughening continuously an aluminum web or an aluminum alloy web transported in an electrolyte solution containing hydrochloric acid, the step comprising plural pairs of first high surface-roughening rate steps and second low or zero surface-roughening rate steps, the first step and the second step being carried out alternately, and an average quantity of electricity of 100 C/dm$^2$ or less being applied at one of the first steps, or (b) electrolytically surface-roughening an aluminum plate or an aluminum alloy plate in an electrolyte solution containing hydrochloric acid, the step being carried out by varying current density to be supplied to comprise plural pairs of first high surface-roughening rate steps and second low or zero surface-roughening rate steps, the first step and the second step being carried out alternately, and an average quantity of electricity of 100 C/dm$^2$ or less being applied at one of the first steps, 6. the method of item 5 above, wherein the average opening size of the small pits is 0.4 to 0.8 $\mu$m, 7. a presensitized planographic printing plate comprising a support and provided thereon, a light sensitive layer, the support being an aluminum plate or an aluminum alloy plate each having been roughened, subjected to surface dissolution with an alkaline solution, anodized and subjected to hydrophilic treatment, wherein the support has a dual-structure with large pits of an average opening size of 3 to 6 $\mu$m and small pits, and the dry thickness of the light sensitive layer is 0.8 to 1.8 g/m$^2$, or 8. the presensitized planographic printing plate of item 7 above, wherein the average opening size of the small pits is 0.4 to 0.8 $\mu$m.

The invention will be explained in detail as follows.

The invention is represented by a method of manufacturing a support for a planographic printing plate wherein in a method to electrolytically surface-roughen a web of aluminum or of its alloy continuously in an acid electrolytic solution by transporting the web in the solution, in such a manner as to have plural pairs of high surface-roughening rate steps and low or zero surface-roughening steps arranged alternately in the entire steps of electrolysis, an average quantity of electricity for one step of the high surface-roughening steps is 100 C/dm$^2$ or less.

Figure 2:
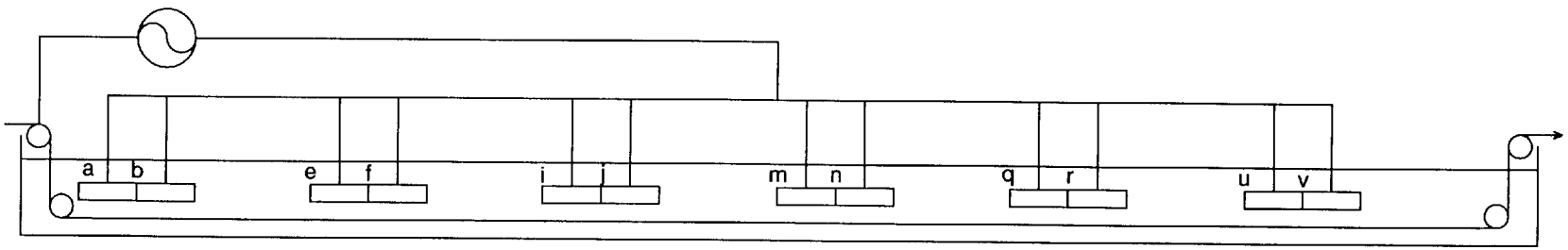
FIG. 2 is a sectional view of an electrolytic apparatus (showing conditions of Example 1-2).

A way to have plural pairs of first high surface-roughening rate steps and second low or zero surface-roughening rate steps, the first step and the second step being carried out alternately, can be achieved by sporadically arranging electrodes as shown in FIG. 2 in an electrolytic apparatus shown in FIG. 1, for example.

In this case, the web faces electrodes at the high surface-roughening rate steps, and the web does not face electrodes at the low or zero surface-roughening rate steps. The high surface-roughening rate steps in the invention refer to the steps in which the average current density (current wave form peak) supplied to the web is 15 A/dm$^2$ or more, and the low or zero surface-roughening rate steps in the invention refer to the steps in which the average current density (current wave form peak) supplied to the web is 10 A/dm$^2$ or less. Even at the portion where the web does not face electrodes, there are portions to which a leakage current from a neighboring electrode flows, and electrolytic surface-roughening does not stop at the entire portion where the web does not face electrodes. However, it is possible to obtain uniform grain when the average quantity of electricity at one step of the high surface-roughening rate steps is 100 C/dm$^2$ or less. The average quantity of electricity at one step of the high surface-roughening rate steps is preferably 20 to 80 C/dm$^2$, and more preferably 30 to 60 C/dM$^2$. The average quantity of electricity at one step of the low or zero surface-roughening rate steps is preferably 0 to 10 C/dM$^2$, and more preferably 0.01 to 5 C/dm$^2$.

Even in another method, for example, in a method wherein there are provided electrolytic tanks in quantity identical to the number of times of surface-roughening, and electrolytic surface-roughening comes to a standstill at the cross-over section between the adjoining electrolytic tanks, the same effect as in the foregoing can naturally be obtained if the average quantity of electricity in one step of the high surface-roughening rate steps (in the electrolytic tanks) is 100 C/dM$^2$ or less. Due to this method, generation of too large pits is inhibited and a uniformly roughened surface can be obtained accordingly. An effect of the present method of manufacturing a support for a planographic printing plate is remarkable especially when an electrolytic solution mainly containing hydrochloric acid is used.

In the manufacturing method mentioned above, it is preferable that the time taken at the low or zero surface-roughening rate steps is 0.6 to 5 seconds.

Though the same effect can be obtained even when the above-mentioned time is made longer, the period of standstill which is longer than 5 sec may extremely lower the productivity. Therefore, the time required of 5 sec or less is preferable.

The invention is a method of manufacturing a support for a planographic printing plate, the method comprising electrolytically surface-roughening a plate of aluminum or of its alloy in an acid electrolytic solution to have plural pairs of first high surface-roughening rate steps and second low or zero surface-roughening rate steps, the first step and the second step being carried out alternately, by changing current density to be supplied, wherein an average quantity of electricity for one step of the first steps is 100 C/dm$^2$ or less.

In the above method of manufacturing a support for a planographic printing plate, it is preferable that time taken at low or zero surface-roughening rate steps is 0.6 to 5 seconds. The same effect as in the method mentioned above can be obtained even in the method of changing current density to be supplied to the support surface to have plural pairs of first high surface-roughening rate steps and second low or zero surface-roughening rate steps, the first step and the second step being carried out alternately, wherein the average quantity of electricity at one of the first steps is 100 C/dm$^2$ or less. In this method generation of too large pits is inhibited, and a uniformly roughened surface can be obtained.

An effect of the method of manufacturing a support for a planographic printing plate in the invention is remarkable especially when an electrolytic solution mainly containing hydrochloric acid is used. The current density at the low or w zero surface-roughening rate steps is preferably 0–10 A/dm$^2$, and more preferably 0.1–2 A/dm$^2$. When the time taken at the low or zero surface-roughening rate steps is not less than 0.6 seconds, an average opening size of large pits is uniform to be within a range of 3–6 $\mu$m, which makes it possible to obtain a roughened surface having no flat portion that is caused by the maldistribution of large pits. Though the same effect can be obtained even when the above-mentioned time required is made longer, the period of standstill which is longer than 5 seconds may extremely lower the productivity. Therefore, the time is preferably 5 seconds or less.

The support for a presensitized planographic printing plate in the invention has a dual structure of large pits and small pits, and an average opening size of large pits of 3 to 6 $\mu$m, wherein the support is prepared by the method comprising the step of (a) electrolytically surface-roughening continuously an aluminum web or an aluminum alloy web transported in an electrolyte solution containing hydrochloric acid, the step comprising plural pairs of first high surface-roughening rate steps and second low or zero surface-roughening rate steps, the first step and the second step being carried out alternately, and an average quantity of electricity of 100 C/dm$^2$ or less being applied per one of the first steps, or (b) electrolytically surface-roughening an aluminum plate or an aluminum alloy plate in an electrolyte solution containing hydrochloric acid, the step being carried out by varying current density to be supplied to comprise plural pairs of first high surface-roughening rate steps and second low or zero surface-roughening rate steps, the first step and the second step being carried out alternately, and an average quantity of electricity of 100 C/dm$^2$ or less being applied per one of the first steps.

It is preferable that the average opening size of the small pits is 0.4 $\mu$m to 0.8 $\mu$m.

In this case, the average opening size of the large pits is one obtained by averaging opening sizes of the dual-structured pits having an opening size of not less than 2 $\mu$m and further having therein pits whose size is not more than 2 $\mu$m. The average opening size of the small pits is one obtained by averaging opening sizes of the pits having an opening size of not more than 2 $\mu$m and further having therein no smaller pits.

The average opening size of the large pits which is made to be 3 $\mu$m to 6 $\mu$m especially improves properties to minimize dot gain at high fineness. This results from that the roughened surface becomes dense and uniform moderately in terms of structure, formation of fine dots is stabilized accordingly, and their forms are made to be uniform.

Due to the roughened surface which becomes dense and uniform moderately in terms of structure, properties to minimize a ball-point pen damage can be improved. A basis for this is considered as follows: when the average opening size of large pits is 3 $\mu$m to 6 $\mu$m, a load applied on a light-sensitive layer by a tip of a ball-point pen is uniformly supported by pit edge portions and thereby damage on the light-sensitive layer is minimized.

Further, it is considered that the average opening size of the small pits has an influence on how a light-sensitive layer comes in contact closely in a small area. When the average opening size is smaller than 0.4 $\mu$m, properties to minimize a ball-point pen damage are slightly deteriorated. A basis for this is considered to be the lowered adhesive property caused by higher possibility that a light-sensitive layer can not enter the pits and causes voids.

The average quantity of electricity of not more than 100 C/dm$^2$ in the invention can be explained as follows. Even when electrodes are arranged at intervals as shown in FIG. 2, or when plural electrolytic solution tanks are provided, in the case of electrolytically surface-roughening an aluminum alloy web continuously, there sometimes occurs that if the electrodes are connected to the power supply in parallel, a quantity of electricity to be applied on each electrolytic portion is not constant in each electrode having the same area. The basis for the foregoing is that a resistance value is increased as electrolysis progresses, and the farther advanced in the web movement direction a position of an electrode is, the less a quantity of electricity to be impressed on the electrode is. Even in such a case, it is possible to obtain the surface form in the invention of a support for the planographic printing plate and to attain the effect of the invention, by arranging electrodes to set an average quantity of electricity of one of the electrolytic surface-roughening steps to be 100 C/dm$^2$ or less.

The invention is preferably a presensitized planographic printing plate comprising a support for the planographic printing plate and a light-sensitive layer provided on the support, the support being a plate of aluminum or its alloy that is surface-roughened, surface-dissolved with alkali, anodized and rendered hydrophilic, wherein the support is of a dual structure having large pits and small pits, an average opening size of the large pits is 3 $\mu$m to 6 $\mu$m, and a dry coating amount of the light-sensitive layer is 0.8 g/m$^2$ to 1.8 g/m$^2$.

It is preferable that an average opening size of the small pits mentioned above is 0.4 $\mu$m to 1.8 $\mu$m.

When the dry coating amount of the light-sensitive layer is made to be 0.8 g/m$^2$ to 1.8 g/m$^2$ in addition to the form of the roughened surface mentioned above, properties to minimize a ball-point pen damage are improved.

An aluminum support used for the presensitized planographic printing plate of the invention includes a support made of pure aluminum and that made of aluminum alloy. As an aluminum alloy, there can be used various ones including an alloy of aluminum and each of metals such as, for example, silicon, copper, manganese, magnesium, chromium, zinc, lead, bismuth, nickel, titanium, sodium and iron.

It is preferable that an aluminum support is subjected to degreasing treatment for removing rolling oil prior to surface-roughening. The degreasing treatment to be used includes degreasing treatment employing solvents such as trichlene and thinner, and an emulsion degreasing treatment employing an emulsion such as kerosene or triethanol. It is also possible to use an aqueous alkali solution such as caustic soda for the degreasing treatment. When an aqueous alkali solution such as caustic soda is used for the degreasing treatment, it is possible to remove soils and oxidized films which can not be removed by the above-mentioned degreasing treatment alone.

After an aqueous alkali solution such as caustic soda is used for the degreasing treatment, it is preferable to conduct neutralizing treatment by dipping in an acid such as phosphoric acid, nitric acid, hydrochloric acid, sulfuric acid and chromic acid, or in mixed acid thereof. When conducting electrochemical surface-roughening after the neutralizing treatment, it is especially preferable that an acid used for the neutralizing is matched with that used for the electrochemical surface-roughening.

As the surface-roughening for a support, electrolytic surface-roughening in the method of the invention is conducted, and a preliminary processing for the electrolytic surface-roughening may be conducted by combining appropriately chemical surface-roughening and/or mechanical surface-roughening.

For the chemical surface-roughening, an aqueous alkali solution such as caustic soda is used similarly to the degreasing treatment. After the processing, it is preferable to conduct neutralizing treatment by dipping in an acid such as phosphoric acid, nitric acid, hydrochloric acid, sulfuric acid or in mixed acid thereof. When conducting electrochemical surface-roughening after the neutralizing processing, it is especially preferable that an acid used for the neutralizing w is matched with that used for the electrochemical surface-roughening.

Though there is no restriction for the mechanical surface-roughening method, brushing and honing are preferable.

In the case of the brushing, surface-roughening is conducted by pressing on the surface of a support a cylindrical brush on which brush bristles each having a diameter of 0.2 mm–1 mm, for example, are flocked, while rotating the cylindrical brush and supplying slurry in which abrasives are dispersed in water between the cylindrical brush and the support.

In the case of the honing, pressurized slurry in which abrasives are dispersed in water is jetted out of a nozzle in such a way as to hit obliquely the surface of a support so that it is roughened.

The abrasive includes those used generally for grinding such as volcanic ashes, alumina and silicon carbide, and a grain size of them is #200–#2000, while the preferable grain size is #400–#800.

It is preferable that the support whose surface has been roughened mechanically is dipped in an acid or an aqueous alkali solution so that the surface of the support is etched, for the purpose of removing abrasives and aluminum dust which are embedded in the surface of the support and of controlling a shape of pits. The acid in this case includes, for example, sulfuric acid, persulfuric acid, hydrofluoric acid, phosphoric acid, nitric acid and hydrochloric acid, while, as a base, there may be given, for example, sodium hydroxide and potassium hydroxide. Among those mentioned above, an aqueous alkali solution is preferably used.

After an aqueous alkali solution is used for dipping processing for the foregoing, it is preferable to dip in an acid such as phosphoric acid, nitric acid, sulfuric acid and chromic acid, or in a mixed acid thereof, for neutralizing processing.

When conducting electrolytic surface-roughening after the neutralizing processing, it is preferable that an acid used for the neutralizing is made to be matched with that used for the electrolytic surface-roughening, while when conducting anodizing treatment after the neutralizing processing, it is preferable that an acid used for the neutralizing is made to be matched with that used for the anodizing treatment.

In the case of the electrolytic surface-roughening in the invention, an alternating current is generally used in an acidic electrolytic solution for the surface-roughening. Though acidic electrolytic solutions generally used for electrolytic surface-roughening can be used, it is preferable to use an electrolytic solution of a hydrochloric acid type or that of a nitric acid type, and it is especially preferable to use an electrolytic solution of a hydrochloric acid type for the split type electrolytic surface-roughening of the invention.

With regard to a waveform of the power supply used for the electrolysis, it is possible to use various waveforms such as a rectangular wave, a trapezoid wave, and a saw tooth wave, and a sine wave is especially preferable.

When electrolytic surface-roughening is carried out using an electrolytic solution of a nitric acid type, voltage applied at the high surface-roughening rate steps in the invention is preferably 10–50 V, and more preferably 12–30 V. The current density (peak value of alternating current wave form) at the high surface-roughening rate steps in the invention is preferably 15–200 A/dM$^2$, and more preferably 20–100 A/dm$^2$.

The total quantity of electricity through the electrolytic surface-roughening is preferably 100–2000 C/dm$^2$, and its range of 200–1500 C/dM$^2$ is more preferable and a range of 200–1000 C/dm$^2$ is still more preferable.

A temperature ranging from 10° C. to 50° C. is preferable, and a range of 15–45° C. is further preferable. The nitric acid concentration ranging from 0.1% by weight to 5% by weight is preferable.

When necessary, it is possible to add, to an electrolytic solution, nitrates, chlorides, amines, aldehydes, phosphoric acid, chromic acid, boric acid, acetic acid or oxalic acid.

When electrolytic surface-roughening is carried out using an electrolytic solution of a hydrochloric acid type, voltage applied at the high surface-roughening rate steps in the invention is preferably 10–50 V, and more preferably 12–30 V. The current density (peak value of alternating current wave form) at the high surface-roughening rate steps in the invention is preferably 15–200 A/dm$^2$, and more preferably 20–100 A/dm$^2$. The total quantity of electricity through the electrolytic surface-roughening ranging from 100 C/dm$^2$ to 2000 C/dm$^2$ is preferable, and a range of 200–1000 C/dm$^2$ is more preferable. A temperature ranging from 10° C. to 50° C. is preferable, and a range of 15–45° C. is more preferable. Hydrochloric acid concentration ranging from 0.1% by weight to 5% by weight is preferable.

When necessary, it is possible to add, to an electrolytic solution, nitrates, chlorides, amines, aldehydes, phosphoric acid, chromic acid, boric acid, acetic acid or N oxalic acid. w It is preferable that the support whose surface has been electrolytically roughened is dipped in an acid or an aqueous alkali solution so that the surface of the support is etched, for the purpose of removing smuts on the surface of the support and of controlling a shape of pits.

The acid in this case includes, for example, sulfuric acid, persulfuric acid, hydrofluoric acid, phosphoric acid, nitric acid and hydrochloric acid, while, as the base, there may be given, for example, sodium hydroxide and potassium hydroxide. Among those mentioned above, an aqueous alkali solution is preferably used. When an aqueous alkali solution is used for dipping processing for the foregoing, it is preferable to dip in an acid such as phosphoric acid, nitric acid, sulfuric acid or chromic acid, or in a mixed acid thereof, for neutralizing processing. When conducting anodizing treatment after the neutralizing processing, it is preferable that an acid used for the neutralizing is made to be matched with that used for the anode-oxidization processing.

After the surface-roughening, anodizing treatment is carried out, and then sealing treatment and hydrophilization treatment are carried out.

There is no restriction in particular for the method of anodizing treatment used in the invention, and known methods can be used. The anodizing treatment forms an oxidized film on the surface of the support. For anodizing treatment in the invention, there is preferably used a method of applying a current density of 1–10 A/dm$^2$ to an aqueous solution containing sulfuric acid and/or phosphoric acid at concentration of 10–50%, as an electrolytic solution. However, it is also possible to use a method of applying a high current density to sulfuric acid as described in U.S. Pat. No. 1,412,768 and a method to electrically etching the support in phosphoric acid as described in U.S. Pat. No. 3,511,661.

The support which has been subjected to anodizing treatment is optionally subjected to sealing treatment. For the sealing treatment, it is possible to use known methods using hot water, boiling water, steam, a sodium silicate solution, an aqueous dicromate solution, a nitrite solution and an ammonium acetate solution.

On the support having been subjected to hydrophilization treatment is coated a light sensitive composition.

Next, the light sensitive composition used in the invention will be explained.

The light sensitive composition used in the invention is not specifically limited, and in the invention, a conventional light sensitive composition used in a presensitized planographic printing plate can be used. The light sensitive composition used in the invention is as follows:

1) Photo-crosslinkable Light Sensitive Resin Composition

The light sensitive component in a photo-crosslinkable light sensitive resin composition includes a light sensitive resin having an unsaturated double bond in the molecule, for example, a light sensitive resin having —CH=CH (C=O)— as a light sensitive group in its main chain, or polyvinyl cinnamate having a light sensitive group in its side chain disclosed in U.S. Pat. Nos. 3,030,208, 3,435,237 and 3,622,208.

2) Photo-polymerizable Light Sensitive Resin Composition

The photo-polymerizable light sensitive resin composition contains an addition-polymerizable unsaturated compound. The composition is composed of a monomer having a double bond or a mixture of a monomer having a double bond and a polymer, and the example thereof includes those disclosed in U.S. Pat. Nos. 2,760,863 and 2,791,504.

The photo-polymerizable composition includes a composition containing methylmethacrylate, a composition containing methylmethacrylate and polymethylmethacrylate, a composition containing methylmethacrylate, polymethylmethacrylate and a polyethylene glycol methacrylate monomer, and a composition containing methylmethacrylate, an alkyd resin and a polyethylene glycol dimethacrylate monomer.

The photo-polymerizable light sensitive resin composition contains a photopolymerization initiator well known in the art such as a benzoin derivative such as benzoin, a benzophenone derivative such as benzophenone, a thioxanthone derivative, an anthraquinone derivative, or an acridone derivative.

3) Light Sensitive Composition containing Diazo Compound

The preferred diazo compound used in the light sensitive composition is a diazo resin obtained by condensation of an aromatic diazonium salt with formaldehyde or acetoaldehyde. Especially preferable is a salt of a condensation product of p-diazophenylamine with formaldehyde or acetoaldehyde, for example, a diazo resin inorganic salt such as a hexafluorophosphate, tetrafluoroborate, perchlorate or periodate salt of the condensation product, or a diazo resin organic salt such as a sulfonate salt of the condensation product disclosed in U.S. Pat. No. 3,300,309.

It is preferable that the diazo resin be used in combination with a binder. As such a binder, various high molecular compounds are available. Of these resins, preferred ones include copolymers between a monomer having an aromatic hydroxyl group such as N-(4-hydroxyphenyl)acrylamide, N-(4-hydroxyphenyl)methacrylamide, o-, m- or p-hydroxystyrene or o-, m- or p-hydroxyphenyl methacrylate and another monomer, as disclosed in Japanese Pat. O.P.I. Pub. No. 98613/1979; polymers containing hydroxyethyl acrylate units or hydroxyethyl methacrylate units as the repetitive unit, as disclosed in U.S. Pat. No. 4,123,276; natural resins such as shellac and rosin; polyvinyl alcohols; polyamide resins disclosed in U.S. Pat. No. 3,751,257; linear polyurethane resins disclosed in U.S. Pat. No. 3,660,097; phthalated polyvinyl alcohol resins; epoxy resins obtained from bisphenol A and epichlorohydrin; and cellulosic resins such as cellulose acetate and cellulose acetate phthalate.

4) Light Sensitive Composition containing o-Quinonediazide Compound

The o-quinonediazide compound is a compound having an o-quinonediazide group in the molecule. The o-quinonediazide compound used in the invention includes an o-naphthoquinonediazide compound such as an ester compound of o-naphthoquinonediazide sulfonic acid and a polycondensate resin of phenols with aldehydes or ketones.

Examples of the phenols used in the polycondensate resin of phenols with aldehydes or ketones include a monohydric phenol such as phenol, o-cresol, m-cresol, p-cresol, 3,5-xylenol, carvacrol and thymol, a dihydric phenol such as catechol, resorcin or hydroquinone, and a trihydric phenol such as pyrogallol or phloroglucin. Examples of the aldehydes include formaldehyde, benzaldehyde, acetaldehyde, crotonaldehyde and furfural. Preferred are formaldehyde and benzaldehyde. Examples of the ketones include acetone, and methyl ethyl ketone.

The examples of the polycondensate resin of phenols with aldehydes or ketones include a phenol-formaldehyde resin, a m-cresol-formaldehyde resin, a mixed m- and p-cresol-formaldehyde resin, a resorcin-benzaldehyde resin, and a pyrogallol-acetone resin.

In the o-naphthoquinonediazide compound, the condensation ratio of the o-naphthoquinonediazide sulfonic acid to the hydroxyl group of the phenol component is 15 to 80 mol %, and preferably 20 to 45 mol %.

The o-quinonediazide compounds used in the invention include those disclosed in Japanese Patent O.P.I. Publication No. 58-43451. The examples thereof include conventional 1,2-quinonediazide compounds such as 1,2-benzoquinonediazidesulfonate, 1,2-benzoquinonediazidesulfonamide, 1,2-naphthoquinonediazide-sulfonate and 1,2-naphthoquinonediazide-sulfonamide and, further, include 1,2-quinonediazide compounds such as 1,2-benzoquinonediazide-4-sulfonic acid phenyl ester, 1,2,1',2'-di-(benzoquinonediazide-4-sulfonyl)dihydroxybiphenyl, 1,2-benzoquinonediazide-4-(N-ethyl-N-β-naphthyl) sulfonamide, 1,2-naphthoquinonediazide-5-sulfonic acid cyclohexyl ester, 1-(1,2-naphthoquinonediazide-5-sulfonyl)-3,5-dimethylpyrazole, 1,2-naphthoquinonediazide-5-sulfonic acid-4'-hydroxydiphenyl-4'-azo-β-naphthol ester, N,N-di-(1,2-naphthoquinonediazide-5-sulfonyl)-aniline, 2'-(1,2-naphthoquinonediazide-5-sulfonyloxy)-1-hydroxyanthraquinone, 1,2-naphthoquinonediazide-5-sulfonic acid-2,4-dibydroxybenzophenone ester, 1,2-naphthoquinonediazide-5-sulfonic acid-2,3,4-trihydroxybenzophenone ester, a condensation product of 2 moles of 1,2-naphthoquinonediazide-5-sulfonic acid chloride with 1 mole of 4,4"-diaminobenzophenone, a condensation product of 2 moles of 1,2-naphthoquinonediazide-5-sulfonic acid chloride with 1 mole of 4,4'-dihydroxy-1,1'-diphenylsulfone, a condensation product between 1 mole of 1,2-naphthoquinonediazide-5-sulfonic acid chloride and 1 mole of purpurogallin, and 1,2-naphthoquinonediazide-5-(N-dihydroxyabiethyl)-sulfonamide described in J. Kosar, Light-Sensitive Systems, John Wily & Sons, New York, pp. 339–352 (1965) and WS. De Forest, Photoresist, Vol. 50, McGraw-Hill, New York (1975). Other examples are 1,2-naphthoquinonediazide compounds described in Japanese Pat. Exam. Pub. Nos. 37-1953, 37-3627, 37/13109, 40/26126, 40/3801, 45/5604, 45/27345 and 51/13013, and Japanese Pat. O.P.I. Pub. Nos. 48/96575, 48/63802 and 48/63803.

Among the above described o-quinonediazide compounds is especially preferable an o-quinonediazide ester compound obtained by reacting 1,2-benzoquinonediazide sulfonylchloride or 1,2-naphthoquinonediazide sulfonylchloride with a pyrogallol-acetone resin or 2,3,4-trihydroxybenzophenone.

In the invention, the o-quinonediazide compound may be used singly or in combination.

The o-quinonediazide compound content of the light sensitive layer is preferably 5 to 60% by weight, and more preferably 10 to 50% by weight.

The light sensitive composition containing the o-quinonediazide compound can further contain a clathrate compound.

The clathrate compound used in the invention is not specifically limited, as long as it is a compound capable of enclosing another compound. The clathrate compound is preferably an organic clathrate compound soluble in a solvent for preparing the composition in the invention. The organic clathrate compound includes those disclosed in Michio Hiraoka et al., "Host Guest Chemistry", (1984), published by Kodansha, Tokyo, A. Collet et al., "Tetrahedron Report", No. 226, p. 5725 (1987), Shinkai et al., "Kagakukogyo, April", p. 278 (1991), and Hiraoka et al., "Kagakukogyo, April", p. 288 (1991).

The clathrate compound preferably used in the invention is cyclic D-glucans, cyclophanes, neutral polyligands, cyclic polyanions, cyclic polycations, cyclic polypeptides, spherands or cabitands, or their acyclic analogs. Among these, cyclic D-glucans and their acyclic analogs, cyclophanes or neutral polyligands are preferable.

The example of the cyclic D-glucans and their acyclic derivatives includes a compound in which α-D-glucopyranoses are connected through a glycoside bond.

The above compound includes saccharides such as starch, amylose or amylopectin, each being composed of D-glucopyranoses, cyclodextrins such as α-cyclodextrin, β-cyclodextrin, γ-cyclodextrin, or cyclodextrin having 9 D-glucopyranose groups, and D-glucan derivatives having a group such as $SO_3C_6H_4CH_2C_6H_4SO_3$, $NHCH_2CH_2NH$, $NHCH_2CH_2NHCH_2CH_2NH$, $SC_6H_5$, $N_3$, $NH_2$, $NEt_2$, $SC(NH^+{}_2)NH_2$, SH, $—S(CH_2CH_2)NH_2$, imidazole or ethylenediamine, represented by the following formulas:

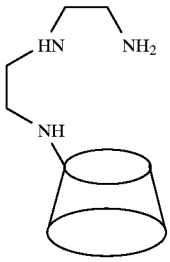

-continued

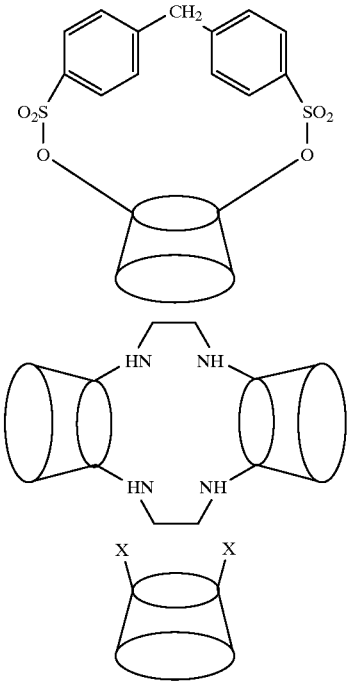

wherein X represents $—C_6H_5$, $—N_3$, $—NH_2$, $—N(C_2H_5)_2$, $—SC(NH_2^+)NH_2$, —SH, $—SCH_2CH_2NH_2$, or

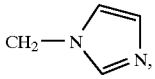

and

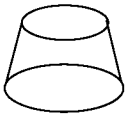

represents cyclodextrin.

The above compound includes a cyclodextrin derivative, branched cyclodextrin or cyclodextrin polymer represented by the following formula (VI) or (VII):

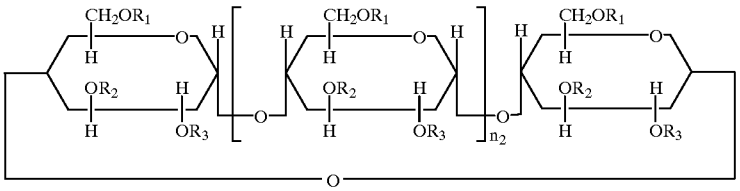

In formula (VI), $R_1$, $R_2$ and $R_3$ may be the same or different, and independently represent a hydrogen atom or substituted or unsubstituted alkyl group; $R_1$ through $R_3$ are preferably a hydrogen group, a hydroxyethyl group or a hydroxypropyl group. It is more preferable that the content of the substituted alkyl group in the molecule is 15 to 50%. $n_2$ represents an integer of 4 to 10.

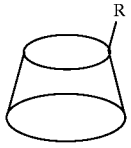

In formula (VII), R independently represents a hydrogen atom, —$R^2$—$CO_2H$, —$R^2$—$SO_3H$, —$R^2$—$NH_2$, or —N—$(R^3)_2$, wherein $R^2$ represents a straight-chained or branched alkylene group having 1 to 5 carbon atoms; and $R^3$ represents a straight-chained or branched alkyl group having 1 to 5 carbon atoms.

The synthetic method of the cyclodextrins is described in Journal of the American Chemical Society, 71, p.354 (1949) and Chemisch Berichte, 90, p. 2561 (1949) and 90, p. 2561 (1957), but is not limited thereto.

Now, a branched cyclodextrin will be explained. The branched cyclodextrin is a compound in which a water soluble substance such as monosaccharide or disaccharide including glucose, maltose, cellobiose, lactose, saccharose, galactose, glucosamine is added or attached to a cyclodextrin known in the art. Preferably, are cited maltosylcyclodextrin in which maltose is attached to cyclodextrin (the number of maltose attached to cyclodextrin may be any of one, two or three molecules) and glucosyldextrin in which glucose is attached to cyclodextrin (the number of glucose attached to cyclodextrin may be any of one, two or three molecules).

The branched cyclodextrin can be synthesized according to methods described in Denpun Kagaku (Starch Chemistry) 33 (2) 119–126 (1986); ibid 33 (2) 127–132 (1986); ibid 30 (2) 231–239 (1983). Maltosylcyclodextrin, for example, can be prepared in such a manner that cyclodextrin and maltose are used as starting materials and maltose is bonded to cyclodextrin by means of enzyme such as isoamirase or pulluranase. Glucosylcyclodextrin can be prepared in a similar manner.

As preferable branched cyclodextrins, the following exemplary compounds are cited below.

Exemplified compound:

D-1; α-cyclodextrin with one attached maltose molecule
D-2; γ-cyclodextrin with one attached maltose molecule
D-3; γ-cyclodextrin with one attached maltose molecule
D-4; α-cyclodextrin with attached two maltose molecules
D-5; β-cyclodextrin with two attached maltose molecules
D-6; γ-cyclodextrin with two attached maltose molecules
D-7; α-cyclodextrin with three attached maltose molecules
D-8; β-cyclodextrin with three attached maltose molecules
D-9; γ-cyclodextrin with three attached maltose molecules
D-10; α-cyclodextrin with one attached glucose molecule
D-11; β-cyclodextrin with one attached glucose molecule
D-12; γ-cyclodextrin with one attached glucose molecule
D-13; α-cyclodextrin with two attached glucose molecules
D-14; β-cyclodextrin with two attached glucose molecules
D-15; γ-cyclodextrin with two attached glucose molecules
D-16; α-cyclodextrin with three attached glucose molecules
D-17; β-cyclodextrin with three attached glucose molecules
D-18; γ-cyclodextrin with three attached glucose molecules With regard to the structure of the branched cyclodextrin, although many studies have been made by means of HPLC, NMR, TLC (Thin layer chromatography), INEPT (insensitive nuclei enhanced by polarization transfer) etc., it is not clearly defined at present. However, it is definite that monosaccharide or disaccharide is attached to the cyclodextrin from the result of above-described measurements. Therefore, in cases where two or more molecules of the monosaccharide or disaccharide are attached, they may be attached to each glucose or to one glucose in the form of a straight chain, as schematically illustrated below.

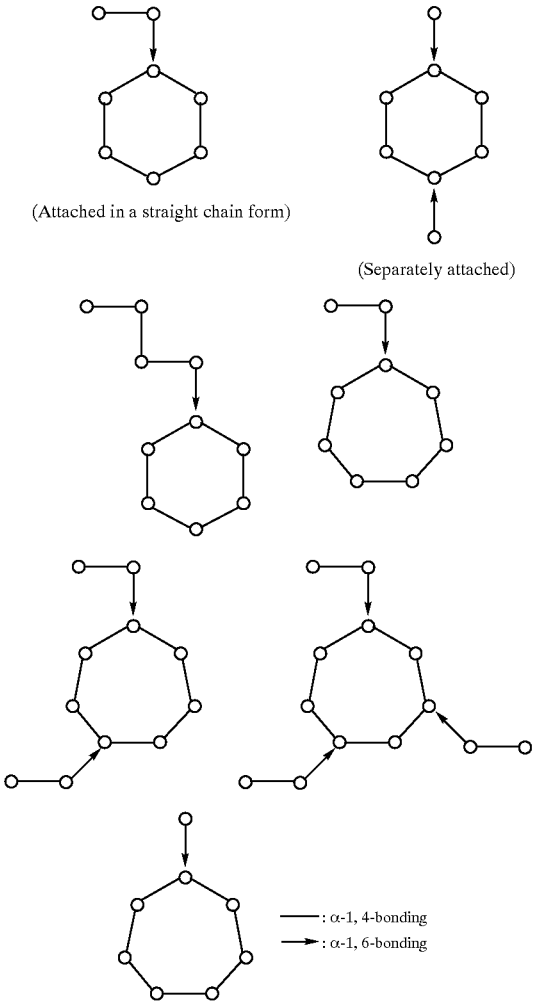

In the above branched cyclodextrin, it is characterized in that the ring structure of the cyclodextrin is preserved so that it exhibits inclusion action similarly to cyclodextrin itself and a water soluble maltose or glucose is attached thereto to enhance its water solubility.

The branched cyclodextrin used in the invention is commercially available. Maltosylcyclodextrin, for example, is available as Isoelite P (trade mark, product by Ensuiko Seitoh Co.)

Next, the cyclodextrin polymer will be explained. The cyclodextrin polymer usable in the invention is represented by the following formula (VIII):

formula (VIII)

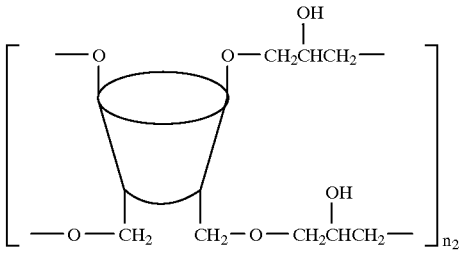

The cyclodextrin polymer can be prepared by cross-linking cyclodextrin with epichlorohydrin to form a polymer. The cyclodextrin polymer is preferably water soluble, more preferably having a solubility of not less than 20 g per 100 g of water at 25° C. Accordingly, in formula (VIII), $n_2$ (alternatively, polymerization degree) is preferably 3 or 4. The smaller this value is, the higher solubility of the cyclodextrin polymer and its solubilizing effect.

These cyclodextrin polymers can be synthesized according to conventional methods described in JP-A 61-97025 and German Patent 3,544,842. The cyclodextrin polymer may be used as a inclusion compound. The cyclodextrin compound is incorporated in the solid developer replenishing composition in an amount so as to be preferably 0.2 to 100 g (more preferably, 0.5 to 40 g) per liter of a replenishing solution.

The cyclophanes are cyclic compounds in which aromatic rings are connected by various bonds, and many cyclophanes are well known. The cyclophanes in the invention includes those well known cyclophanes. The bonds connecting the aromatic rings include a single bond, a —$(CR_1CR_2)_m$— group, a —$O(CR_1CR_2)_mO$— group, a —$NH(CR_1CR_2)_mNH$— group, a —$(CR_1CR_2)_p$—$NR_3$ $(CR_4CR_5)_9$— group, a —$(CR_1CR_2)_p$—$N^+R_3R_4CR_5CR_6)_q$— group, a —$(CR_1CR_2)_p$—$S^+R_3CR_4CR_5)_q$— group, a —$CO_2$— group and a —$CONR_1$— group, wherein $R_1$, $R_2$, $R_3$, $R_4$, $R_5$ and $R_6$ may be the same as or different, and independently represent a hydrogen atom or an alkyl group having 1 to 3 carbon atoms; and m, p and q may be the same as or different, and independently represent an integer of 1 to 3.

The above described compounds include paracyclophanes represented by the following formula:

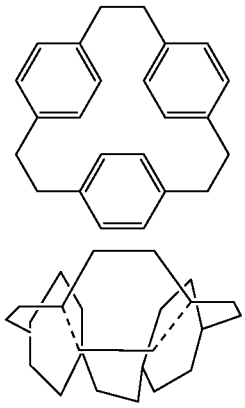

-continued

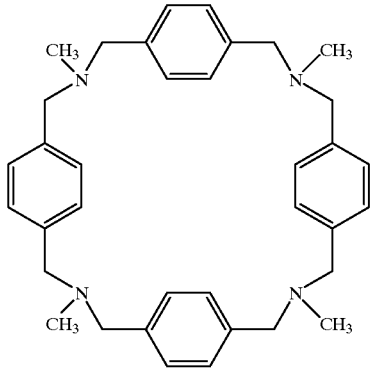

wherein

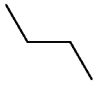

represents —$CH_2CH_2$—; orthocyclophanes such as tri-o-teimotide or cyclotriveratrylene represented by the following formula:

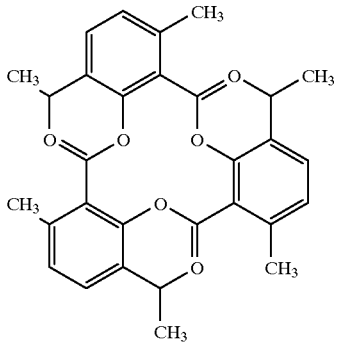

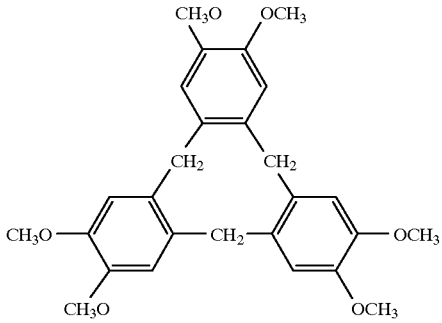

metacyclophanes such as metacyclophane, calixarene and resorcinol-aldehyde cyclic oligomer represented by the following formula:

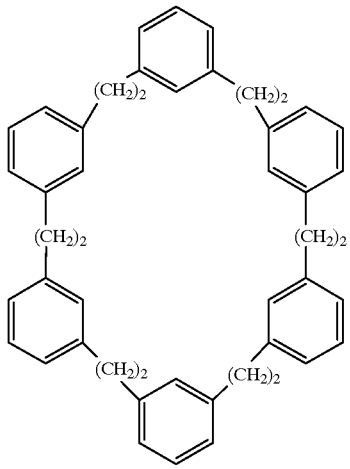

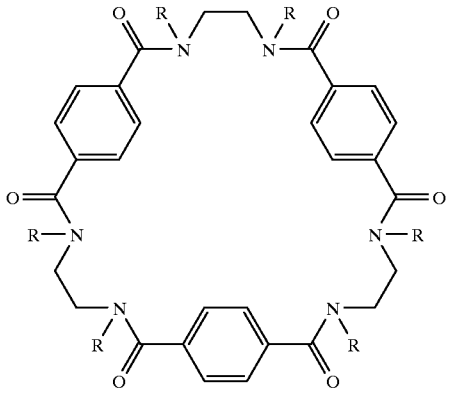

wherein R represents —$CH_2C_6H_5$,

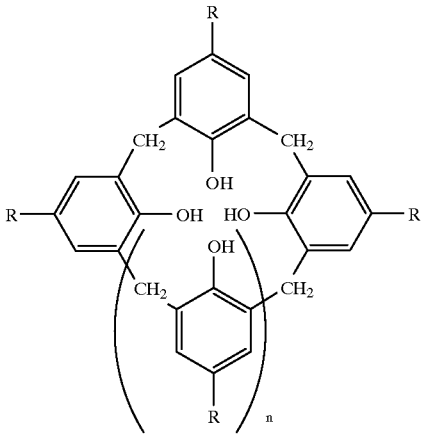

wherein R represents Cl, —$CH_3$, -t—$C_4H_9$, —$C_6H_5$, —$CO_2C_2H_5$ or -i—$C_3H_7$; and n represents 4, 5, 6, 7 or 8,

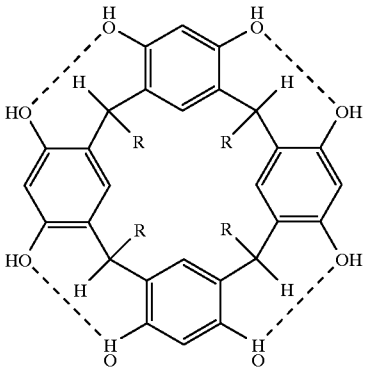

wherein R represents —$CH_3$ or —$C_6H_5$; and a acyclic oligomer of para-substituted phenols represented by the folowing formula:

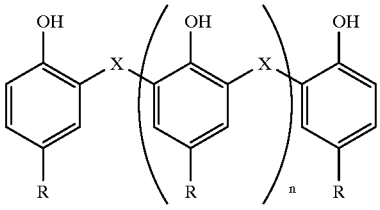

wherein X represents —$CH_2$—, —S—, or a single bond, R represents —$CH_3$ or -t—$C_4H_9$, and n represents an integer of 1 to 10.

The neutral polyligand includes a crown compound, cryptand, cyclic polyamines, or their acyclic analogs. It is well known that this compound can effectively enclose a metal ion, but it can also effectively enclose a cationic organic molecule.

Another clathrate compound includes urea, thiourea, deoxycholic acid, dinitrodiphenyl, o-tritymotide, hydroxyflavone, dicyanoammine nickel, dioxytriphenylmethane, triphenylmethane, methylnaphthalene, spirocuromane, perhydrotriphenylene, clay mineral, graphite, geolite (faujasite, chabazite, mordenite, levynite, monmolinite or halosite), cellulose, amylose and protein.

These clathrate compounds may be added singly, and can be added in combination with a polymer having a substituent having an enclosing property at its side chain in order to improve solubility or miscibility with other additives of the clathrate compound itself or a clathrate compound enclosing a molecule.

The above polymer can be synthesized by methods disclosed in Japanese Patent O.P.I. Publication Nos. 3-221501, 3-221502, 3-221503, 3-221504 and 3-221505.

Among the above clathrate compounds, cyclic or acyclic D-glucans, cyclophanes or acyclic cyclopahane analogs are preferable. Further concretely, cyclodextrins, calixarene, resorcinol-aldehyde cyclic oligomers or para-substituted phenol alicyclic oligomer are preferable.

The still more preferable includes cyclodextrins or derivatives thereof, and the most preferable includes β-cyclodextrins or derivatives thereof.

The content of the clathrate compound in the light sensitive composition is preferably 0.01 to 10% by weight, and more preferably 0.1 to 5% by weight.

The light sensitive composition containing an o-quinonediazide compound preferably contains an alkali soluble resin. The alkali soluble resin used with the o-quinonediazide compound includes a novolak resin, a vinyl polymer having a phenolic hydroxy group, and a polycondensate of polyhydric phenol with aldehyde or ketone disclosed in Japanese Patent O.P.I. Publication No. 55-57841.

The above novolak resin includes a phenol-formaldehyde resin, a cresol-formaldehyde resin, a phenol-cresol-formaldehyde resin disclosed in Japanese Patent O.P.I. Publication No. 55-57841, and a copolycondensate of a p-substituted phenol, and phenol or cresol with formaldehyde disclosed in Japanese Patent O.P.I. Publication No. 55-127553.

The novolak resin has a number average molecular weight (Mn) of preferably $3.00\times10^2$ to $7.50\times10^3$, more preferably $5.00\times10^2$ to $4.00\times10^3$, and a weight average molecular weight (Mw) of preferably $1.00\times10^3$ to $3.00\times10^4$, more preferably $3.00\times10^3$ to $2.00\times10^4$, in terms of polystyrene standard.

The above novolak resin may be used singly or in combination.

When the novolak resin is used, the novolak resin content of the light sensitive layer is preferably 5 to 95% by weight.

The vinyl polymer having a phenolic hydroxy group herein referred to implies a polymer having a group with the phenolic hydroxy group in the polymer molecule structure, and preferably has a structural unit represented by the following formulas (I) through (V):

formula (I)

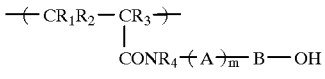

formula (II)

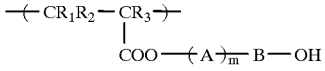

formula (III)

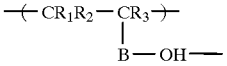

formula (IV)

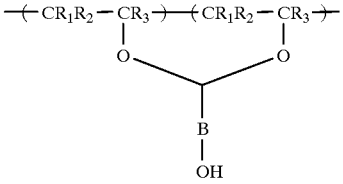

formula (V)

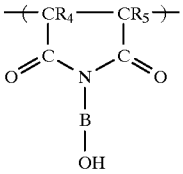

In formulas (I) through (V), $R_1$ and $R_2$ independently represent a hydrogen atom, an alkyl group or a carboxy group, and preferably represent hydrogen atoms; $R_3$ represents a hydrogen atom, a halogen atom or an alkyl group, and preferably represent a hydrogen atom or an alkyl group such as methyl or ethyl; $R_4$ and $R_5$ independently represent a hydrogen atom, an alkyl group, an aryl group or an aralkyl group, and preferably represent hydrogen atoms; A represents a substituted or unsubstituted alkylene group combining the aromatic carbon atom with the nitrogen or oxygen atom; m represents an integer of 0 to 10; and B represents a substituted or unsubstituted phenyl group or a substituted or unsubstituted naphthyl group.

The vinyl polymer used in the invention having the above phenolic hydroxy group is preferably a copolymer having the structures represented by formulas (I) through (V) above. The monomer used for copolymerization includes an ethylenically unsaturated olefin such as ethylene, propylene, isobutylene, butadiene or isoprene; styrene such as styrene, α-methylstyrene, p-methylstyrene or p-chloromethystyrene; acrylic acid such as acrylic acid or methacrylic acid; an unsaturated aliphatic dicarboxylic acid such as itaconic acid, maleic acid or maleic anhydride; an α-methylene aliphatic monocarboxylic acid ester such as methylacrylate, ethylacrylate, n-butylacrylate, isobutylacrylate, dodecylacrylate, 2-chloroethylacrylate, phenylacrylate, α-chloromethylacrylate, methylmethacrylate, ethylmethacrylate or ethylethacrylate, ethylacrylate; a nitrile such as acrylonitrile or methacrylonitrile; an amide such as acryl amide; an anilide such as m-nitroacrylanilide or m-methoxyacrylanilide; a vinyl ester such as vinyl acetate, vinyl propionate or vinyl benzoate; vinyl ether such as methylvinyl ether, ethylvinyl ether, isobutylvinyl ether or β-chloroethylvinyl ether; vinyl chloride; vinylidene chloride; vinylidene cyanide; an ethylene derivative such as 1-methyl-1-methoxyethylene, 1,1-dimethoxyethylene, 1,2-dimethoxyethylene, 1,1-dimethoxycarbonylethylene or 1-methyl-1-nitroxyethylene; and an N-vinyl monomer such as N-vinylindole, N-vinylpyrrolidine, or N-vinylpyrrolidone. These monomers are present in the copolymer in the cleavage form of the double bond.

Among the above monomers, the aliphatic monocarboxylic acid ester or nitrile is preferable, in that it exhibits the superior performance of the invention. The monomers may be contained in the copolymer at random or in the form of block.

When the vinyl polymer containing a phenolic hydroxy group is used, the polymer is contained in the light sensitive layer in an amount of preferably 0.5 to 70% by weight.

The vinyl polymer containing a phenolic hydroxy group may be used singly or in combination. The vinyl polymer may be used in combination with anothe polymer.

When the alkali soluble polymer is used, an o-quinonediazide compound content of the light sensitive layer is preferably 5 to 60% by weight, and more preferably 10 to 50% by weight.

The light sensitive composition disclosed in Japanese Patent Publication Nos. 2-12752 and 7-98429 can be used in the light sensitive composition in the invention.

In the invention, a print-out material is used to form a visible image after exposure. The print-out material is composed of a compound capable of producing an acid or free radical on light exposure and an organic dye varying its color on reaction with the free radical or acid. The example of the compound capable of producing an acid or free radical on light exposure includes o-naphthoquinonediazide-4-sulfonic acid halogenide disclosed in Japanese Patent O.P.I. Publication No. 50-36209, a trihalomethylpyrone or trihalomethyltriazine disclosed in Japanese Patent O.P.I. Publication No. 53-36223, an ester compound of o-naphthoquinonediazide-4-sulfonic acid chloride with a phenol having an electron-attractive group or an amide compound of o-naphthoquinonediazide-4-sulfonic acid chloride with aniline disclosed in Japanese Patent O.P.I. Publication No. 55-6244, a halomethylvinyloxadiazole or diazonium salt disclosed in Japanese Patent O.P.I. Publication Nos. 55-77742 and 57-148784. The organic dye includes Victoria Pure Blue BOH (produced by Hodogaya Kagaku Co. Ltd.), Patent Pure Blue (produced by Sumitomomikuni Kagaku Co. Ltd.), Oil Blue #603 (produced by Orient Kagaku Co. Ltd.), Sudan Blue II (produced by BASF), Crystal Violet, Malachite Green, Fuchsin, Methyl Violet, Ethyl Violet, Methyl Orange, Brilliant green, Eosine, Congo Red and Rhodamine 66.

The light sensitive composition in the invention optionally contains a plastcizer, a surfactant, an organic acid or an acid anhydride, besides the above described.

The light sensitive composition in the invention may further contain an lipophilic agent for improving a lipophilicity of image portions such as a p-tert-butylphenol-formaldehyde resin, a p-n-octylphenol-formaldehyde resin or their resins thereof partially esterified with an o-quinonediazide compound.

The light sensitive layer in the invention can be formed by dissolving or dispersing the light sensitive composition in a solvent to obtain a coating solution, coating the solution on a support and then drying the coated.

The solvent for dissolving the light sensitive composition includes methylcellosolve, methylcellosolve acetate, ethylcellosolve, ethylcellosolve acetate, diethylene glycol monomethylether, diethylene glycol monoethylether, diethylene glycol dimethylether, diethylene glycol methylethylether, diethylene glycol diethylether, diethylene glycol monoisopropylether, propylene glycol, propylene glycol monoethylether acetate, propylene glycol monobutylether, dipropylene glycol monomethylether, dipropylene glycol dimethylether, dipropylene glycol methylethylether, ethyl formate, propyl formate, butyl formate, amyl formate, methyl acetate, ethyl acetate, propyl acetate, butyl acetate, methyl propionate, ethyl propionate, methyl butyrate, ethyl butyrate, dimethylformamide, dimethylsulfoxide, dioxane, acetone, methylethylketone, cyclohexanone, methylcyclohexanone, discetonealcohol, acetylacetone, y-butyrolactone. These solvents can be used singly or in combination.

The binder used in the invention includes an acryl polymer and methylmethacrylate (MMA)/ethylmethacrylate (EMA)/acrylonitrile (AN)/methacrylic acid (MAA) copolymer in which may be partially esterified with glycidylmethacrylate (GMA).

The monomer used in the polymer is a compound having at least one ethylenically unsaturated bond. The example thereof includes a single functional acrylate such as 2-ethylhexylacrylate, 2-hydroxyethylacrylate or 2-hydroxypropylacrylate or its derivatives and its methacrylate or maleate alternatives.

The polymerization initiator includes carbonyl compounds, organic sulfur compounds, peroxides, redox compounds, azo or diazo compounds, halides and photoreducing agents disclosed in J. Kosar, "Light Sensitive Systems", Paragraph 5. The examples thereof are disclosed in English Patent No. 1,459,563.

The coating method for coating the light sensitive composition on a support includes a conventional coating method such as whirl coating, dip coating, air-knife coating, spray coating, air-spray coating, static air-spray coating, roll coating, blade coating or curtain coating. The coating amount is preferably 0.05 to 5.0 g/m$^2$ as a solid, although the amount varies depending on the usage.

The dry coating amount of the light sensitive layer is preferably 0.8 to 1.8 g/m$^2$, and more preferably 1.2 to 1.6 g/m$^2$. The light sensitive layer optionally contains a matting agent.

A protective layer can be provided on the surface of the support opposite the light sensitive layer as disclosed in Japanese Patent O.P.I. Publication Nos. 50-151136, 57-63293, 60-73538, 61-67863 and 6-35174, whereby aluminum dissolution in a developing solution is prevented or the light sensitive layer scratching damage is minimized when presensitized planographic printing plates are stacked.

Similarly, the protective layer can be provided on the light sensitive layer. The protective layer preferably has a high solubility in the developing solution (generally an alkaline solution). The compound used in the protective layer includes polyvinyl alcohol, polyvinyl pyrrolidone, gelatin, casein, gum arabic, and a water soluble amide.

Imagewise exposure is carried out employing an ordinary analogue light source, but laser scanning exposure is especially preferable. The various laser can be used in accordance with the spectral sensitivity or sensitivity of the light sensitive layer. The laser for imagewise exposure includes a helium-cadmium laser, an argon ion laser, a helium-neon laser, a semiconductor laser, a YAG laser or a combination of the YAG laser and an optical element in which the wavelength is halved.

EXAMPLES

The invention will further be explained concretely as follows, referring to the examples to which the invention is not limited.

Example 1/Comparative example 1

A 0.24-mm thick aluminum web (material 1050, refining H 16) was dipped and degreased for 5 seconds in a 10% sodium hydroxide aqueous solution kept at 85° C., then washed with water, and further dipped for 10 seconds in a 10% hydrochloric acid aqueous solution kept at 25° C. to neutralize, and then washed with water. The resulting aluminum web was continuously subjected to electrolytic surface-roughening treatment by the use of an electrolytic apparatus shown in FIGS. 1 and 2 using an electrolytic solution of a 25° C., aqueous 10 g/l hydrochloric acid solution with electrodes arranged and line speed shown in Table 1. FIG. 1 shows an electrolytic apparatus in which 24 dismountable electrodes "a" through "x", each having a length of 20 cm in the transport direction, are placed in electrolytic solution 1 of electrolytic tank 2. Voltage is supplied to the electrodes by AC power supply 3 so that the transporting aluminum web is electrolytically surface-roughened. The distance between the electrodes and the surface of the web in this case was kept at 10 mm. FIG. 2 shows the same electrolytic apparatus as FIG. 1, except that electrodes c, d, g, h, k, 1, o, p, s, t, w, and x of the 24 electrodes "a" through "x" are removed. After the electrolytic surface-roughening, the web was dipped in a 1% sodium hydroxide aqueous solution kept at 50° C. to be etched so that a dissolution amount of aluminum (an alkali etching amount) was 2.0 g/m$^2$, then dipped for 10 seconds to be neutralized in a 10% sulfuric acid aqueous solution kept at 25° C., and then was washed with water. After that, the web was subjected to anodization in a 20% sulfuric acid aqueous solution for 1 minute at 25° C. in terms of a 2 A/dm$^2$ current density. Thus, a support for a planographic printing plate was obtained.

Uniformity of large pits and an average opening size of large pits both on the surface of the support were evaluated/ measured through the following methods. Results thereof are shown in Tables 1 and 2.

Example 2/Comparative example 2

A 0.24-mm-thick aluminum plate (material 1050, refining H 16) was dipped in a 10% sodium hydroxide aqueous solution kept at 85° C. to be degreased for 5 seconds, then was washed with water, and was dipped for 10 seconds to be neutralized in a 10% hydrochloric acid aqueous solution kept at 25° C., and then was washed with water. Then, the aluminum plate was subjected to electrolytic surface-roughening treatment by the use of an electrolytic apparatus of a batch type and an electrolytic solution of a 10 g/l hydrochloric acid aqueous solution at 25° C. under the conditions of an average quantity of electricity for processing shown in Table 3 and others. A distance between the electrode and the surface of the plate in this case was kept to be 10 mm. After the electrolytic surface-roughening, the plate was dipped in a 1% sodium hydroxide aqueous solution kept at 50° C. to be etched so that a dissolution amount of aluminum was 2.0 g/m$^2$, then dipped to be neutralized for 10 seconds in a 10% sulfuric acid aqueous solution kept at 25° C., and then was washed with water. After that, the resulting plate was subjected to anodization in a 20% sulfuric acid aqueous solution for 1 minute at 25° C. in terms of a 2 A/dm$^2$ current density. Thus, a support for a planographic printing plate was obtained.

Uniformity of large pits and an average opening size of large pits both on the surface of the support for a planographic printing plate thus obtained were evaluated/measured through the following methods. Results thereof are shown in Table 3.

Example 3/Comparative example 3

As shown in Table 4, electrolytic surface-roughening was carried out under the same condition as in Example 1/Comparative example 1 or in Example 2/Comparative example 2. After the electrolytic surface-roughening, the aluminum web or plate was dipped in a 1% sodium hydroxide aqueous solution kept at 50° C. to be etched so that a dissolution amount of aluminum was the value shown in Table 4, then dipped for 10 seconds to be neutralized in a 10% sulfuric acid aqueous solution kept at 25° C., and then was washed with water. After that, the resulting web or plate was subjected to anodization in a 20% sulfuric acid aqueous solution for 1 minute at 25° C. in terms of a 2 A/dm$^2$ current density. Then, the web or plate was dipped for 30 seconds in a 0.1% ammonium acetate aqueous solution kept at 80° C. to carry out sealing treatment, then was dried at 80° C. for 5 minutes, thus each support for a planographic printing plate was obtained.

With regard to Comparative examples 3-9 and 3-10, an electrolytic apparatus of a batch type was used only for electrolytic surface-roughening, and an electrolytic solution of a 10 g/l nitric acid aqueous solution at 25° C. was used, and the electrolytic surface-roughening was carried out under the condition of a quantity of electricity for one cycle of processing in Comparative example 2-4 and other conditions, then etching was conducted so that a dissolution amount of aluminum was the value shown in Table 4, to be followed by the same processing.

An average opening size of small pits on the surface of the support was evaluated/measured by the following method. The results are shown in Table 4. For the average opening size of large pits on the surface of the support, there are shown in Table 4 the values obtained through measurement in Example 1/Comparative example 1 or in Example 2/Comparative example 2.

Next, a coating solution of light-sensitive composite having the following composition was coated on each support obtained above for a planographic printing plate by the use of a wire bar, and dried at 80° C., thus a presensitized planographic printing plate was obtained. In this case, coating weight of each light-sensitive composite was arranged so that its weight of dry coating was the value shown in Table 4.

| (Positive-Working Light Sensitive Layer) | |
|---|---|
| Novolak resin (phenol/m-cresol/p-cresol, 10/54/36, mol ratio), Mw: 4,000) | 6.70 g |
| Condensation product (esterification rate: 30%) of a pyrogallol-acetone resin (Mw: 3,000) with o-naphthoquinone diazide-5-sulfonylchloride | 1.50 g |
| Polyethylene glycol #2,000 | 0.20 g |
| Bictoria Pure Blue BOH (made by Hodogaya Kagaku Co., Ltd.) | 0.08 g |
| 2,4-Bis(trichloromethyl)-6-(p-methoxystyryl)-s-tyriazine | 0.15 g |
| FC-430 (made by Sumitom 3M Co., Ltd.) | 0.03 g |
| Cis-1,2-Cyclohexanedicarboxylic acid | 0.02 g |
| Methyl cellosolve | 100 ml |

The support and presensitized planographic printing plate obtained above were evaluated according to the following method.

(Evaluation of Support)

Using an SEM photograph of the support surface, the large pit uniformity was evaluated, and the average opening size of the large and small pits was measured. The large pits herein referred to implies dual-structured pits having an opening size exceeding 2 μm and further having additional pits of 2 μm or less in the inner walls, while the small pits herein referred to implies ones having an opening size of 0.1 to 2 μm without additional pits in the inner walls. Pits having an opening size of less than 0.1 μm were ignored.

The 500 power SEM photograph of the support surface was measured, and uniformity of the large pits was evaluated according to good/poor criteria.

The average opening size of the large pits was obtained from a 1,000 power SEM photograph of the support surface as follows:

The major and minor axis lengths of the large pits having a clear periphery were measured, and their average was computed to obtain an opening size. Thereafter, the average opening size of the total large pits was computed.

The average opening size of the small pits was obtained, from a 500 power SEM photograph of the support surface, in the same manner as for the large pits.

(Evaluation of Printing Property)

The presensitized planographic printing plate obtained above was exposed through an original having a 600 lines/inch chart at 8 mw/cm$^2$ for 60 seconds employing a 4 kw metal halide lamp. The exposed plate was then developed at 27° C. for 20 seconds employing a developer obtained by diluting with water by 6 factors a commercially available developer SDR-1 (made by Konica Corporation) to obtain a positive-working planographic printing plate. The resulting printing plate was evaluated according to the following method.

Evaluation of dot gain at high fineness

Employing the printing plate obtained above, printing was carried out on a printing machine (DAIYA1F-1 produced by Mitsubishi Jukogyo Co., Ltd.), wherein a coated paper, dampening water (Etch Solution SG-51 (Concentration 1.5%) produced by Tokyo Ink Co., Ltd.) and printing ink (Hyplus M magenta produced by Toyo Ink Manufacturing Co., Ltd.) were used. Printing was carried out to give an image density of 1.6, and the dot on the two hundredth printing matter at 50% dot area at 600 line/inch was measured for dot gain. Measurement was carried out using a Macbeth densitometer.

(Evaluation of Stain on Blanket)

Printing was carried out in the same printing conditions as above. After five thousand sheets of coated paper was printed, stain on the blanket (on blanket portions corresponding to non-image portions on the printing plate) was evaluated. The cello tape was adhered to, and peeled from the blanket, and the peeled cello tape was adhered to a white paper. The collophane tape on the paper was visually observed, and stain was evaluated according to good/poor criteria.

Ball Point Pen Damage of Light Sensitive Layer

A straight line was drawn on unexposed portions of the pesensitized planographic printing plate before development, using a ball point pen. The resulting plate was developed in the same manner as above, and the light sensitive layer at portions in which the straight line was drawn was observed using a differential interference microscope. The ball point pen damage of the light sensitive layer was evaluated according to good/poor criteria.

TABLE 1

| Example/ Comparative example | Electrodes to be used (portions indicated with screen) | | | | | | | | | | | | | | | | | | | | | | | | Line speed |
|---|---|---|---|---|---|---|---|---|---|---|---|---|---|---|---|---|---|---|---|---|---|---|---|---|---|
| | a | b | c | d | e | f | g | h | i | j | k | l | m | n | o | p | q | r | s | t | u | v | w | x | (cm/sec) |
| Example 1-1 | ▒ | ▒ | ▒ | | ▒ | ▒ | ▒ | | ▒ | ▒ | ▒ | | ▒ | ▒ | ▒ | | ▒ | ▒ | ▒ | | ▒ | ▒ | ▒ | | 10 |
| Example 1-2 | ▒ | ▒ | | | ▒ | ▒ | | | ▒ | ▒ | | | ▒ | ▒ | | | ▒ | ▒ | | | ▒ | ▒ | | | 10 |
| Example 1-3 | ▒ | | ▒ | | ▒ | | ▒ | | ▒ | | ▒ | | ▒ | | ▒ | | ▒ | | ▒ | | ▒ | | ▒ | | 10 |
| Example 1-4 | ▒ | ▒ | ▒ | | ▒ | ▒ | ▒ | | ▒ | ▒ | ▒ | | ▒ | ▒ | ▒ | | ▒ | ▒ | ▒ | | ▒ | ▒ | ▒ | | 20 |
| Example 1-5 | ▒ | | ▒ | | ▒ | | ▒ | | ▒ | | ▒ | | ▒ | | ▒ | | ▒ | | ▒ | | ▒ | | ▒ | | 15 |
| Comparative example 1-1 | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | ▒ | 10 |
| Comparative example 1-2 | ▒ | ▒ | ▒ | ▒ | ▒ | ▒ | | | ▒ | ▒ | ▒ | ▒ | ▒ | ▒ | | | ▒ | ▒ | ▒ | ▒ | ▒ | ▒ | | | 10 |
| Comparative example 1-3 | ▒ | ▒ | ▒ | ▒ | | | ▒ | ▒ | ▒ | ▒ | | | ▒ | ▒ | ▒ | ▒ | | | ▒ | ▒ | ▒ | ▒ | | | 10 |

TABLE 2

| Example/ Comparative example | Current density supplied (average value) ($A/dm^2$) | Quantity of electricity supplied ($C/dm^2$) | Quantity of electricity at one of high surface-roughening rate steps (average value) ($C/dm^2$) | Time period taken at one of low or zero surface-roughening rate steps (average value) (seconds) | Uniformity of large pits | Average opening size of large pits ($\mu m$) |
|---|---|---|---|---|---|---|
| Example 1-1 | 52.4 | 600 | 100 | 2.0 | Good | 5.2 |
| Example 1-1 | 78.5 | 600 | 100 | 4.0 | Good | 4.8 |
| Example 1-1 | 78.5 | 600 | 50 | 2.0 | Very good | 4.2 |
| Example 1-1 | 104.7 | 600 | 100 | 1.0 | Good | 4.5 |
| Example 1-1 | 117.8 | 600 | 50 | 1.3 | Very good | 3.8 |
| Comparative example 1-1 | 39.3 | 600 | 600 | 0.0 | Poor | 13.5 |
| Comparative example 1-1 | 52.4 | 600 | 200 | 4.0 | Poor | 12.0 |
| Comparative example 1-1 | 58.9 | 600 | 150 | 4.0 | Poor | 9.3 |

TABLE 3

| Example/ Comparative example | Current density supplied ($A/dm^2$) | Quantity of electricity supplied at one of high surface-roughening rate steps ($C/dm^2$) | Frequency of high surface-roughening rate steps (times) | Quantity of electricity supplied (Total) ($C/dm^2$) | Current density supplied at one of low or zero surface-roughening rate steps ($A/dm^2$) | Time period taken at one of low or zero surface-roughening rate steps (seconds) | Uniformity of large pits | Average opening size of large pits ($\mu m$) |
|---|---|---|---|---|---|---|---|---|
| Example 2-1 | 50 | 100 | 6 | 600 | 1 | 1.0 | Good | 5.0 |
| Example 2-2 | 50 | 100 | 6 | 600 | 0.1 | 3.0 | Good | 4.9 |
| Example 2-3 | 50 | 50 | 12 | 600 | 0.1 | 0.7 | Good | 5.2 |
| Example 2-4 | 50 | 50 | 12 | 600 | 0.1 | 1.0 | Very good | 3.8 |
| Example 2-5 | 50 | 50 | 12 | 600 | 0.1 | 4.0 | Very good | 3.5 |
| Example 2-6 | 50 | 50 | 12 | 600 | 2 | 2.0 | Very good | 3.6 |
| Example 2-7 | 100 | 100 | 6 | 600 | 0.1 | 0.7 | Good | 5.7 |
| Example 2-8 | 100 | 100 | 6 | 600 | 2 | 2.0 | Good | 4.8 |
| Example 2-9 | 100 | 50 | 12 | 600 | 1 | 1.0 | Very good | 3.5 |
| Example 2-10 | 100 | 50 | 12 | 600 | 0.1 | 2.0 | Very good | 3.4 |
| Comparative example 2-1 | 50 | 600 | 1 | 600 | — | — | Poor | 13.3 |
| Comparative example 2-2 | 100 | 600 | 1 | 600 | — | — | Poor | 12.4 |
| Comparative example 2-3 | 50 | 200 | 3 | 600 | 0 | 1.0 | Poor | 12.2 |
| Comparative example 2-4 | 50 | 150 | 4 | 600 | 0 | 0.5 | Poor | 11.6 |
| Comparative example 2-5 | 50 | 150 | 4 | 600 | 0 | 1.0 | Poor | 9.6 |
| Comparative example 2-6 | 50 | 150 | 4 | 600 | 0.1 | 3.0 | Poor | 9.2 |
| Comparative example 2-7 | 100 | 150 | 4 | 600 | 0.1 | 2.0 | Poor | 8.6 |
| Comparative example 2-8 | 100 | 150 | 4 | 600 | 2 | 1.0 | Poor | 9.1 |

TABLE 4

| Example/ Comparative example | Surface-roughening method for a support | Alkali-etching amount after electrolytically roughening ($g/m^2$) | Average opening size of large pits ($\mu m$) | Average opening size of small pits ($\mu m$) | Coating amount of light-sensitive layer ($g/m^2$) | Dot gain 600 lines/inch (%) | Ball-point pen damage | Stain on blanket |
|---|---|---|---|---|---|---|---|---|
| Example 3-1 | Example 1-2 | 2.0 | 4.8 | 0.6 | 2.0 | 18 | Good | Good |
| Example 3-2 | Example 1-3 | 1.5 | 4.2 | 0.4 | 2.0 | 17 | Good | Good |
| Example 3-3 | Example 2-3 | 2.0 | 5.2 | 0.6 | 2.0 | 18 | Good | Good |
| Example 3-4 | Example 2-8 | 3.0 | 4.8 | 0.8 | 2.0 | 17 | Good | Good |
| Example 3-5 | Example 2-9 | 2.0 | 3.5 | 0.6 | 2.0 | 15 | Good | Good |
| Example 3-6 | Example 1-2 | 2.0 | 4.8 | 0.6 | 1.8 | 17 | Very good | Good |
| Example 3-7 | Example 1-3 | 2.0 | 4.2 | 0.6 | 1.4 | 15 | Very good | Good |
| Example 3-8 | Example 2-3 | 2.0 | 5.2 | 0.6 | 1.6 | 16 | Very good | Good |
| Example 3-9 | Example 2-8 | 2.0 | 4.8 | 0.6 | 1.5 | 16 | Very good | Good |
| Example 3-10 | Example 2-9 | 2.0 | 3.5 | 0.6 | 1.2 | 14 | Very good | Good |
| Example 3-11 | Example 1-2 | 1.5 | 4.8 | 0.4 | 1.8 | 17 | Very good | Good |
| Example 3-12 | Example 1-3 | 0.6 | 4.2 | 0.2 | 1.8 | 20 | Good | Good |
| Example 3-13 | Example 2-3 | 3.0 | 5.2 | 0.8 | 1.6 | 15 | Very good | Good |
| Example 3-14 | Example 2-8 | 5.0 | 4.8 | 1.0 | 1.6 | 16 | Good | Good |
| Comparative example 3-1 | Example 1-3 | 2.0 | 9.3 | 0.6 | 2.0 | 26 | Poor | Good |
| Comparative example 3-2 | Example 2-1 | 2.0 | 13.3 | 0.6 | 1.6 | 28 | Poor | Good |
| Comparative example 3-3 | Example 2-4 | 2.0 | 11.6 | 0.6 | 2.0 | 29 | Poor | Good |
| Comparative example 3-4 | Example 2-7 | 2.0 | 8.4 | 0.6 | 2.0 | 25 | Poor | Good |
| Comparative example 3-5 | Example 1-3 | 5.0 | 9.3 | 1.0 | 1.8 | 25 | Poor | Good |
| Comparative example 3-6 | Example 2-1 | 0.6 | 13.3 | 0.2 | 2.0 | 32 | Very poor | Good |
| Comparative example 3-7 | Example 2-4 | 2.0 | 11.6 | 0.6 | 1.4 | 27 | Poor | Good |
| Comparative example 3-8 | Example 2-7 | 2.0 | 8.4 | 0.6 | 1.6 | 23 | Poor | Good |

TABLE 4-continued

| Example/ Comparative example | Surface-roughening method for a support | Alkali-etching amount after electrolytically roughening ($g/m^2$) | Average opening size of large pits ($\mu m$) | Average opening size of small pits ($\mu m$) | Coating amount of light-sensitive layer ($g/m^2$) | Dot gain 600 lines/inch (%) | Ball-point pen damage | Stain on blanket |
|---|---|---|---|---|---|---|---|---|
| Comparative example 3-9 | Nitric acid electrolysis | 0.6 | None | 1.5 | 1.8 | 22 | Poor | Very poor |
| Comparative example 3-10 | Nitric acid electrolysis | 1.5 | None | 1.8 | 1.8 | 22 | Poor | Good |

As is apparent from Tables 1–4, the examples of the invention are superior to the comparative examples on the point of the effect of the invention.

What is claimed is:

1. A method of manufacturing a support of a presensitized planographic printing plate having a light-sensitive layer, the method comprising the step of:

electrolytically surface-roughening an aluminum plate or an aluminum alloy plate in an acidic electrolyte solution in which an electrode is placed, the surface-roughening step comprising a first step and a second step carried out alternately, the electrode being positioned to face the plate in the first step and the electrode being positioned not facing the plate in the second step; and subjecting the surface-roughened plate to an anodizing treatment, wherein an average quantity of electricity of 100 $C/dm^2$ or less is supplied at the first step.

2. The method of claim 1, wherein the average quantity of electricity of 20 to 80 $C/dm^2$ is supplied at the first step.

3. The method of claim 1, wherein the second steps are carried out in 0.6 to 5 seconds.

4. The method of claim 1, wherein the processing is carried out by varying current density supplied to the aluminum plate or an aluminum alloy plate.

5. The method of claim 1, wherein the support has large pits with an average opening size of 3 to 6 $\mu m$, and small pits on its surface.

6. The method of claim 5, wherein the average opening size of the small pits is 0.4 to 0.8 $\mu m$.

7. The method of claim 5, wherein the electrolytically surface-roughened plate is further subjected to dissolution treatment with an alkaline solution, anodized, and subjected to hydrophilization treatment, and the light sensitive layer of the presensitized planographic printing plate has a dry thickness of 0.8 to 1.8 $g/m^2$ on the support.

8. The method of claim 1, wherein the light sensitive layer of the presensitized planographic printing plate has a dry thickness of 0.8 to 1.8 $g/m^2$ on the support.

9. The method of claim 8, wherein the light sensitive layer contains an o-quinonediazide compound.

10. The method of claim 1, wherein the total quantity of electricity is 100 to 2000 $C/dm^2$ through the electrolytic surface-roughening.

11. The method of claim 1, wherein the total quantity of electricity is 200 to 1500 $C/dm^2$ through the electrolytic surface-roughening.

* * * * *